US008307607B2

(12) United States Patent
Conterno

(10) Patent No.: US 8,307,607 B2
(45) Date of Patent: Nov. 13, 2012

(54) CONNECTING ELEMENTS FOR PANELS AND PANEL COVERING ASSEMBLIES

(75) Inventor: Cosimo Conterno, Mendrisio (CH)

(73) Assignee: Politec Polimeri Tecnici S.A., Stabio (CH)

( * ) Notice: Subject to any disclaimer, the term of this patent is extended or adjusted under 35 U.S.C. 154(b) by 0 days.

(21) Appl. No.: 12/931,349

(22) Filed: Jan. 28, 2011

(65) Prior Publication Data

US 2011/0225926 A1 Sep. 22, 2011

(30) Foreign Application Priority Data

Jan. 29, 2010 (IT) ..... MI2010A0131

(51) Int. Cl.
*E04B 2/00* (2006.01)
*E04B 1/61* (2006.01)

(52) U.S. Cl. ..... 52/766; 52/762; 52/764

(58) Field of Classification Search ..... 52/766, 52/764, 762, 782.1, 489.1, 578, 584.1
See application file for complete search history.

(56) References Cited

U.S. PATENT DOCUMENTS

| | | | | |
|---|---|---|---|---|
| 2,711,138 | A | 6/1955 | Hart | |
| 3,367,077 | A * | 2/1968 | Johnston | 52/464 |
| 4,528,785 | A | 7/1985 | De Jager | |
| 6,141,923 | A * | 11/2000 | Habicht et al. | 52/235 |
| 6,347,495 | B1 * | 2/2002 | Conterno | 52/483.1 |
| 6,536,175 | B2 * | 3/2003 | Conterno | 52/489.1 |
| 6,792,730 | B2 * | 9/2004 | Richardson | 52/586.2 |
| 6,802,157 | B2 * | 10/2004 | Hallsten | 52/3 |

FOREIGN PATENT DOCUMENTS

| | | |
|---|---|---|
| DE | 23 36 747 A1 | 2/1975 |
| GB | 650 239 A | 2/1951 |
| GB | 1 056 800 A | 1/1967 |

OTHER PUBLICATIONS

Italian Search Report dated Sep. 2, 2010.

* cited by examiner

*Primary Examiner* — Mark Wendell
(74) *Attorney, Agent, or Firm* — Hedman & Costigan, P.C.; James V. Costigan

(57) ABSTRACT

Connecting element for panels (11, 12) comprising a flange (19) having a presser (19') at a first end, a first longitudinal seat (20*a*) for receiving and engaging an extension (13) of a first panel (11) in an intermediate portion, and a enlarged base (28) at a second end, said first longitudinal seat (20*a*) being open in an area adjacent to said flange and delimited, besides by said flange (19) also by a first lateral wall (22) opposite to said flange (19) and by a first base wall (25) for connecting said first lateral wall (22) with said flange (19), said enlarged base (28) defining with a first projection (29), which extends from a first end thereof towards said first base wall (25), a first longitudinal channel (20*b*) delimited by said flange (19), said first base wall (25), said enlarged base (28) and said first projection (29), wherein said first base wall (25) extends in the direction orthogonal to said flange (19) at least over a section equivalent to the distance between said flange (19) and said first projection (29).

8 Claims, 3 Drawing Sheets

CONNECTING ELEMENTS FOR PANELS AND PANEL COVERING ASSEMBLIES

The present invention refers to connecting elements for panels and panel covering assemblies.

In the building industry, for example in the covering structures the term "panels" is used to indicate both actual panels and sheets or walls as well as similar elements which specifically cooperate to provide such structures.

These panels, brought together two by two along an end edge of both, are joined and made integral by means of "connecting elements" which engage the mutual edges thereof and provide a stable and safe connection, making the structure integral.

Both the panels and the connecting elements can be made of different materials, such as for example polycarbonate, aluminium or other specific resins.

In the building industry, numerous panels and connecting elements, of various types, which cooperate together to obtain assemblies of a remarkable complexity have been provided and known up to date.

However, some of the components of these known assemblies are not immediately and easily associated to each other.

Actually, it is possible that a first panel be easily inserted in the connecting element, while a second panel is difficult to insert in presence of the first inserted panel.

Another possible drawback lies in the fact that, with the panels and connecting element connected, there does not occur a good sealing between the parts, with possibility of disengagement from one side.

Another possible drawback observable in some of the known assemblies lies in the fact that, by providing the teeth connection portions, the construction thereof is not that easy and positioning thereof causes some difficulties as well as—at the same time—not guaranteeing safe stability and at times causing hazardous handling due to the presence of the sharp parts of the teeth.

In order to overcome such drawbacks currently known is another type of joining elements described in patent GB 2413340.

Such elements are distinguished by the presence of an upper substantially V-shaped insertion and coupling portion for the ends of two adjacent panels.

In particular, in order to stably hold panels, in the centreline of the inclined sides that define the V-shaped portion there is provided a vertical element, called "presser", which pushes the ends of the panels towards the inner walls of the same V-shaped portion.

As shown in the abovementioned English patent, the inclined walls of the V-shaped portion for coupling panels are joined to each other—at the lower part—by means of a short section of base wall horizontal and orthogonal to the presser which forms a collection basin for the water that may possibly penetrate between the adjacent panels.

In other words the upper insertion and coupling portion for the ends of two adjacent panels described in GB 2413340 has a frusto-conical shape with the larger base open and facing upwards.

At the lower part of the upper portion for coupling the panels there is an extension of the presser ending with an enlarged base substantially orthogonal to the presser.

Such enlarged base projects from both sides of the presser and it is provided for at the lateral ends of two projections facing upwards substantially inclined and parallel to the inclined sides of the V-shaped portion.

In such prior art technique the orthogonal development of the base wall with respect to the presser is always smaller than the distance between the abovementioned projections and the same presser.

Though they efficiently hold the panels, these prior art joining elements described in GB 2413340 reveal some drawbacks.

A first drawback lies in the fact that such joining elements described in GB 2413340 do not allow supporting mobile panels coverings.

Such disadvantage derives from the fact that a possible movable support lying on the enlarged base would be guided during movement only at the lower part and thus would be easily subjected to "derailing" hence blocking the movement of the mobile covering, and/or damaging both the connecting element and the entire structure.

Another drawback of the connecting element described in GB 2413340 lies in the fact that, due to the V-shape of the upper portion for coupling with the panels, the basin for collecting the water possibly penetrating between the adjacent panels has a very small volume available for collecting water.

A further drawback of the connecting element described in GB 2413340 lies in the particular geometry provided for the coupling between the enlarged heads of the panels and the joint.

Actually, the seat for receiving the enlarged heads of the panels comprises portions which serve for holding both at the upper part and at the lower part of the enlarged heads creating lower zones where water may possibly stagnate.

Given that the panels are usually made of polycarbonate, such presence of water is extremely disadvantageous due to the possible creation of mould which would lead to an early deterioration of the polycarbonate.

Furthermore, the coupling geometry defined in GB 2413340 complicates operations related both to positioning the panels and painting the joints.

Another type of elements for joining panels is described in GB1056800, DE2336747, GB650239, and U.S. Pat. No. 2,711,138.

However, all these devices reveal the serious drawback of requiring the presence of an additional element with respect to the connecting element, such as a clip or threaded element, with the aim of guaranteeing the coupling of the panels to the joint.

Disadvantageously, such clip or threaded element could actually loosen over time and jeopardize the stability of the coupling.

An object of the present invention is that of providing elements for connecting panels and panel covering assemblies capable of allowing an easy and immediate coupling between the panels and the installation of mobile elements for covering panels.

Another object of the present invention is that of providing elements for connecting panels and panel covering assemblies having good resistance characteristics both general and at the connect area where there is provided for a large basin for collecting water that might possibly penetrate between the adjacent panels.

These and other objects according to the present invention are attained by providing elements for connecting panels and panel covering assemblies outlined respectively in claims 1 and 7.

Further characteristics of the invention are subject of the dependent claims.

Characteristics and advantages of elements for connecting panels and panel covering assemblies according to the present invention shall be more apparent from the following exemplifying and non-limiting description with reference to the attached schematic drawings wherein.

Figure 1B:
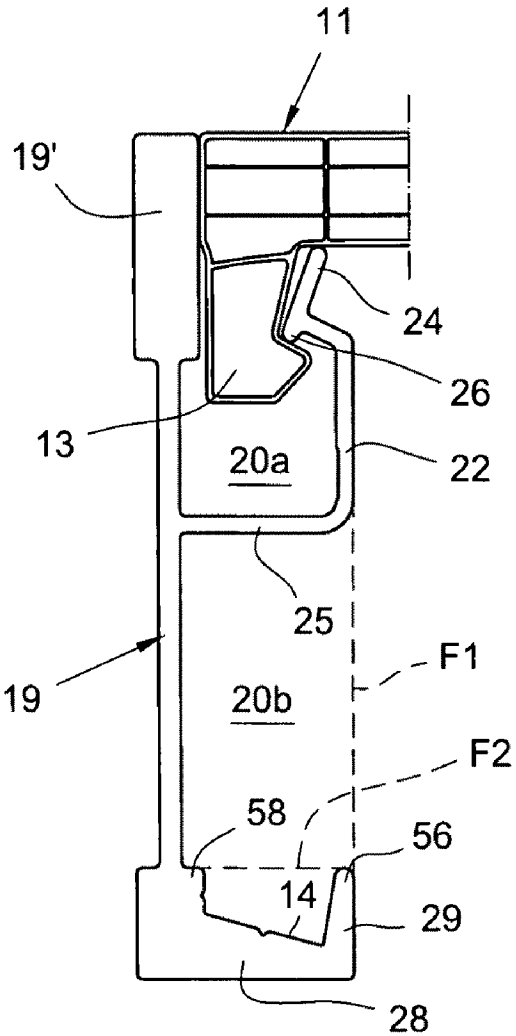
FIGS. 1 and 1B show cross-sectional views of two different embodiments of elements for connecting panels according to the present invention.
Figure 1:
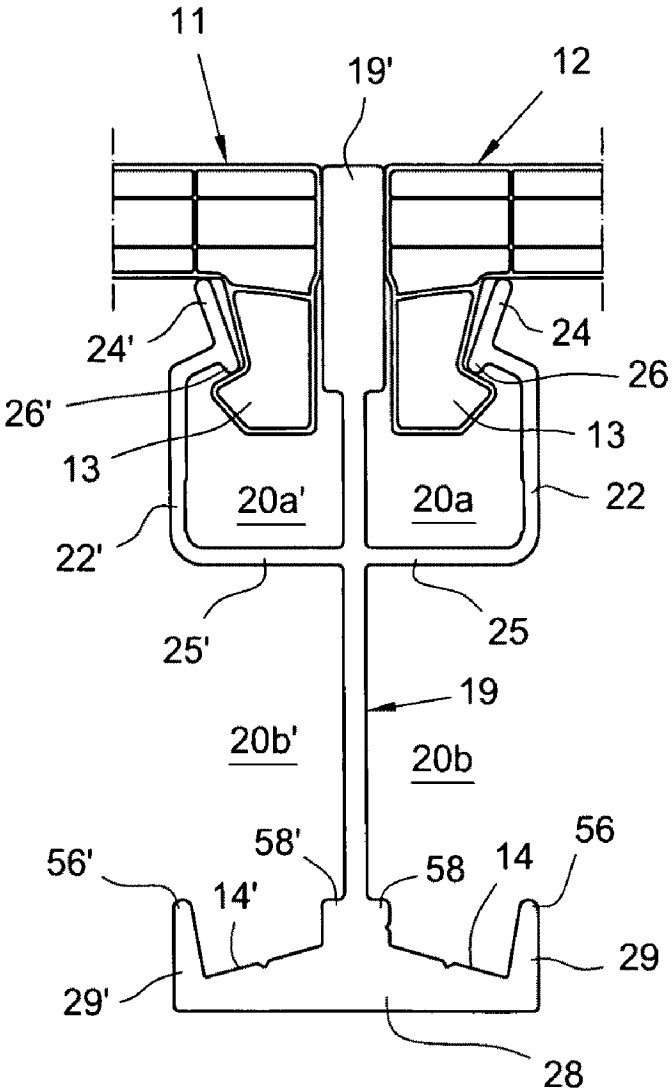

With reference to FIGS. 1 and 1B there are shown two connecting elements according to the present invention wherein FIG. 1B shows an element for connecting panels positionable at the left end, or at the right end if turned symmetrically, of a panel covering assembly, while FIG. 1 shows an element for connecting panels positionable in an intermediate position of the same panel covering assembly where there is the joining of two ends of two adjacent panels.

The following description shall mainly address the embodiment observable in FIG. 1B, however, it is pointed out that the other embodiment shown in FIG. 1 is simply an implementation of the invention wherein the elements shown in FIG. 1B are split symmetrically with respect to a flange 19 common to the two embodiments and which shall be described hereinafter.

The element for connecting panels shown in FIG. 1B comprises a vertical flange 19 having, in a per se known manner, a presser 19' at a first end, a first longitudinal seat 20*a* for receiving and engaging an extension 13 of a panel 11 in an intermediate portion, and an enlarged base 28 at a second end.

The longitudinal seat 20*a* is open at the upper part in an area adjacent to the flange 19 and delimited, besides by the flange 19, also by a first lateral wall 22, opposite and facing the flange 19, and by a first base wall 25 for connecting the first lateral wall 22 with the flange 19.

The enlarged base 28, develops starting from the flange 19 on the same side where there is the first longitudinal seat 20*a*, it is provided with a first projection 29 which extends from a first end thereof towards the first base wall 25.

According to the information above it is thus possible to define a first longitudinal channel 20*b* delimited by the flange 19, by the first base wall 25, by the enlarged base 28 and by the first projection 29.

In other words, the element for connecting panels shown in FIG. 1B consists—at the upper part—in a longitudinal seat 20*a* U-shaped open at the upper part and—at the lower part—in a longitudinal channel 20*b* opened laterally C-shaped where the lower side of the longitudinal seat 20*a* and the upper side of the longitudinal channel 20*b* are provided by the first base wall 25.

The element distinguishing the invention with respect to the most recent prior art, identified by the Applicant GB 2413340, corresponds to the fact that the first base wall 25, as previously described provides both the lower side of the longitudinal seat 20*a* and the upper side of the longitudinal channel 20*b*, extends in the direction orthogonal to the flange 19 at least over a section equivalent to the distance between the flange 19 and the first projection 29.

The advantages deriving from such arrangement shall be apparent from the description below with reference to the panel covering assemblies that can be obtained through the aforementioned connecting element.

According to the preferred embodiment shown in FIG. 1B the first base wall 25 is substantially orthogonal to the flange 19 and the first lateral wall 22 is substantially orthogonal to the first base wall 25.

Hence, the first lateral wall 22 is substantially parallel to the flange 19.

Regarding the enlarged base 28, also the latter is substantially orthogonal to the flange 19 and the first projection 29 is substantially orthogonal to the enlarged base 28.

Hence, the first projection 29 is substantially parallel to the flange 19 and to the first lateral wall 22.

In the embodiment deemed most advantageous by the Applicant both in functional and dimensional terms, shown in FIG. 1B, the first projection 29 is substantially flushed with the first lateral wall 22, i.e. they are positioned along the same line F1 parallel to the flange 19.

FIG. 1 shows a second embodiment of a connecting element according to the present invention in which there is a second longitudinal seat 20*a'* and a second longitudinal channel 20*b'*.

In particular such second seat 20*a'* and such second channel 20*b'* are arranged and configured symmetrically to the first seat 20*a* and to the first channel 20*b* with respect to the flange 19.

Hence, also the second longitudinal seat 20*a'* is U-shaped and open at the upper part and in an area adjacent to the flange 19 and is delimited, besides by the flange 19, also by a second lateral wall 22', opposite facing the flange 19, and by a second base wall 25' for connecting the second lateral wall 22' with the flange 19.

In such embodiment, the enlarged base 28, which develops starting from the flange 19 from both ends thereof, is also provided with a second projection 29' which extends from the second end thereof towards the second base wall 25' so as to define a second longitudinal channel 20*b* delimited by the flange 19, by the second base wall 25', by the enlarged base 28 and by the second projection 29'.

Also in such embodiment there is the same special technical characteristic indicated as characterizing in the present described embodiment i.e. the fact that also the second base wall 25', which provides both the lower side of the second longitudinal seat 20*a'* and the upper side of the second longitudinal channel 20*b'*, extends in the direction orthogonal to the flange 19 at least over a section equivalent to the distance between the flange 19 and the second projection 29'.

In other words, as observable in FIG. 1, such connecting element for panels comprises—at the upper part—two U-shaped symmetrical longitudinal upper seats 20*a*, 20*a'* and—at the lower part—two C-shaped symmetrical longitudinal channels 20*b*, 20*b'* wherein the abovementioned mirror-like symmetry is intended with respect to the flange 19.

Figure 2:
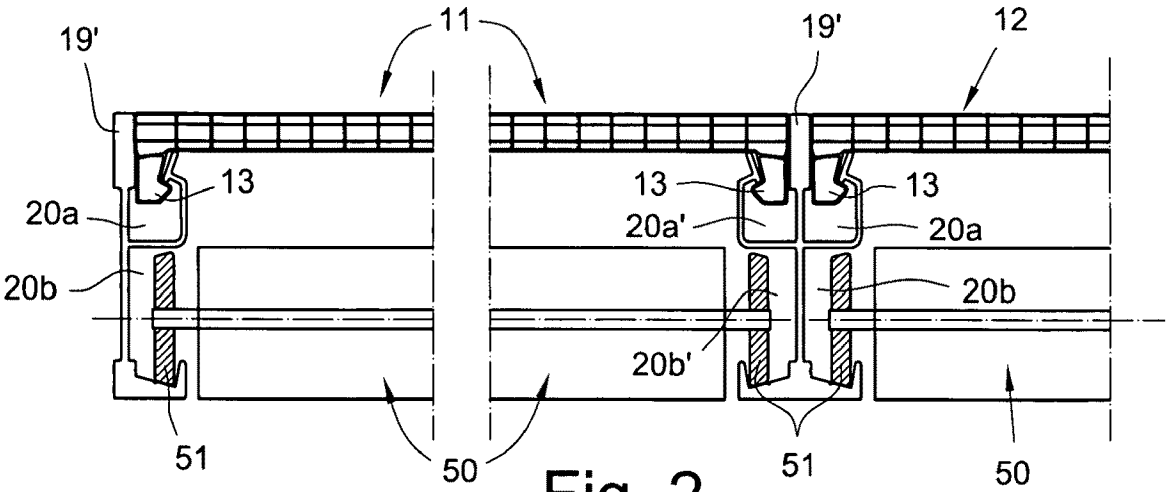
FIGS. 2 and 3 show two cross-sectional views of two different embodiments of panel covering assemblies according to the present invention.
Figure 3:
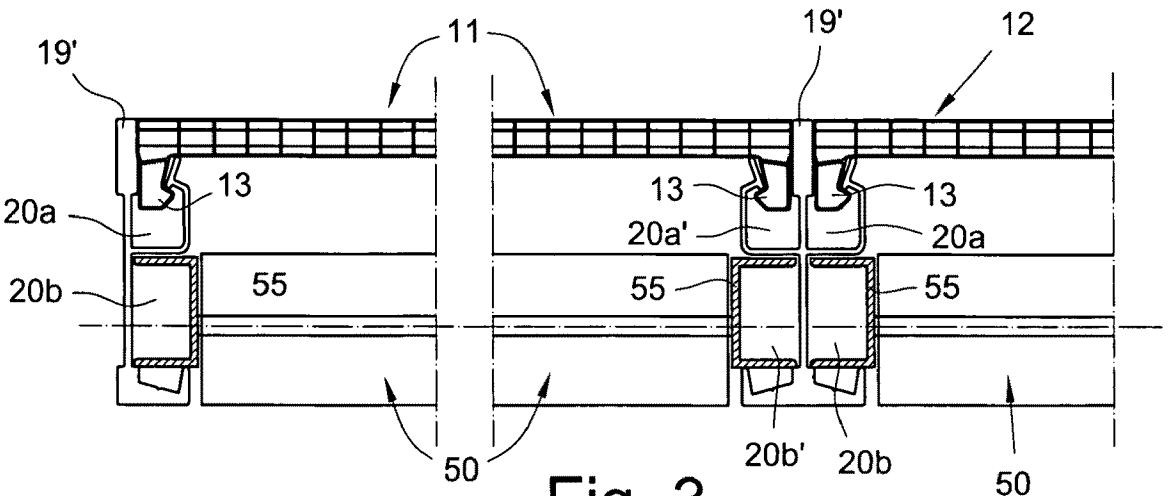
Figure 5:
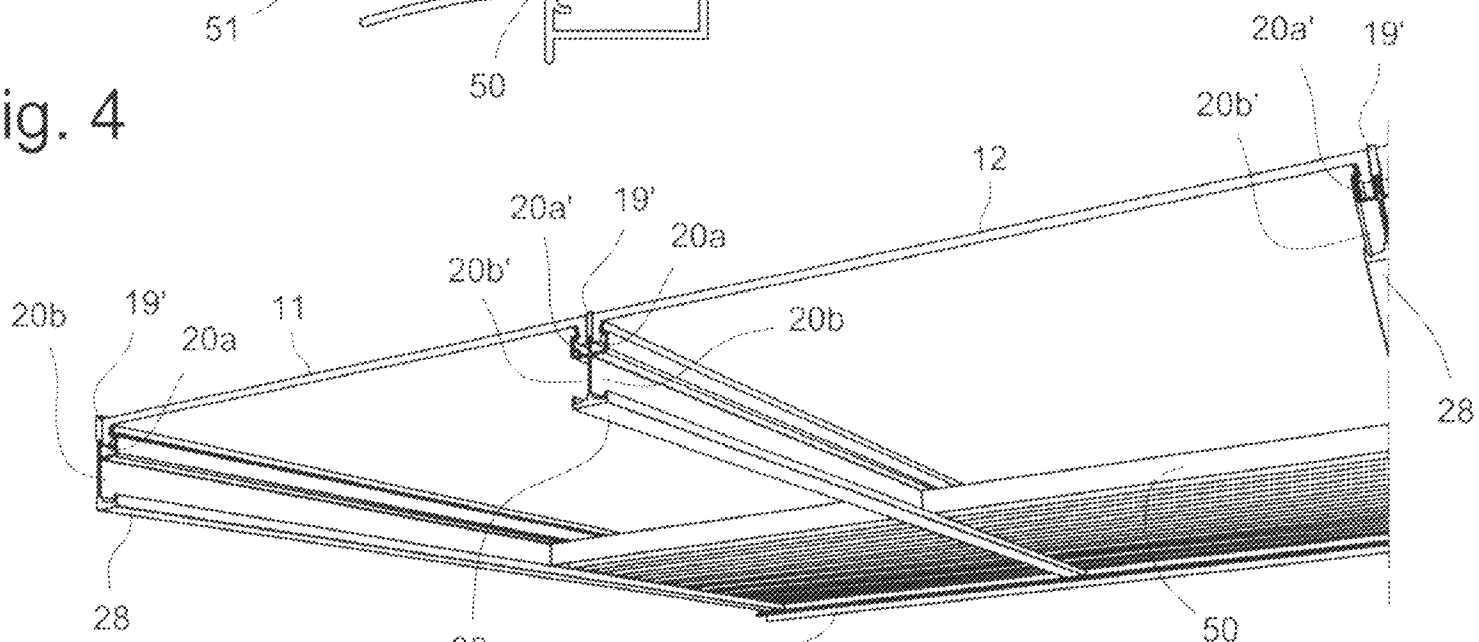
FIG. 5 shows a perspective view of a panels covering assembly according to the present invention.

In FIGS. 2, 3 and 5 there are shown some examples of panel covering assemblies that can be obtained by means of the previously described connecting elements.

As easily evincible, the connecting elements of FIG. 1B are intended to serve as support only for the lateral sides of the covering assembly, actually such connecting elements allow supporting only one end of a panel, while the connecting elements of FIG. 1 are arranged at an intermediate position of the covering assembly given that they can support two ends of two adjacent panels.

As shown in FIGS. 2-3, the panels 11 and 12 are per se of the known type and they have—at the opposite ends—enlarged-head extensions 13 with body tapered towards the enlarged end thereof.

When the panels are associated to relative connecting elements, the enlarged-head extensions 13 are snap-fitted into the relative longitudinal upper seats 20*a*, 20*a*' so that they press against the presser 19' from the outer side and against the upper ends of the lateral walls 22, 22' from the inner side.

In particular, such upper ends of the lateral walls 22, 22' are provided with means for holding the abovementioned extension 13 such as, for example, an area with inclined surface 24, 24'.

As shown, the inclined surfaces 24, 24' converge inwards and towards the central base walls 25, 25' of the seats 20*a*, 20*a*' so that the enlarged ends of extensions 13 abut only at the upper part with the lower ends 26, 26', preferably rounded, of the inclined surfaces 24, 24'.

Contrary to what is provided for in the prior art document GB 2413340, according to the present invention the lower surface of the enlarged ends of the extensions 13 is free so as to avoid possible stagnation of water which could jeopardise the polycarbonate forming the panels.

The area with inclined surface 24, 24' thus both facilitates the insertion of the extensions 13 into the seats 20*a* 20*a*' and holds them.

Preferably, given that the lateral 22, 22' and base 25, 25' walls of the seats 20*a*, 20*a*' are respectively substantially parallel and orthogonal to the presser 19', it is advantageously provided for to increase—with respect to the prior art—the dimensions of the basin for collecting water that could possibly penetrate into the seats 20*a*, 20*a*' between the adjacent panels 11, 12.

The panel covering assembly according to the present invention also comprises a mobile covering 50, preferably of the bellow type, slidable within the channels 20*b*, 20*b'*.

Advantageously such channels 20*b*, 20*b*', contrary to the most recent prior art described in GB 2413340, is adapted to receive mobile lateral supports 51, 55 for self-propelled coverings 50 along the development of the connecting element eliminating the hazard related to possible derailing of such covering 50 during the respective opening and closing movement.

Actually, given that the base walls 25, 25' extend in the direction orthogonal to the flange 19 at least over a distance equivalent to that present between the flange 19 and the projections 29, 29' of the base 28, such mobile lateral supports 51, 55 inserted in the channels 20*b*, 20*b*' are guided during motion thereof, rotationally or by translation, not only at the lower part and, at least partly, laterally like in the prior art, but also at the upper part due to the extension of the base walls 25, 25' at least up to the projections 29, 29'.

According to a first embodiment, shown in FIG. 2, the abovementioned lateral supports can be of the mobile roller 51 type rolling within the channels 20*b*, 20*b*' of the connecting element.

In such case, in which the upper surfaces 14, 14' of the base 28 preferably are inclined at the opposite sides of the flange 19 towards the projections 29, 29', the rollers 51 are arranged in abutment against the projections 29, 29' and they are guided both at the upper part and at the lower part respectively by the base walls 25, 25' and by the upper surfaces 14, 14' of the lower base 28.

In the illustrated example, the rollers 51 are provided with a frusto-conical section complementary to the profile of the inclined upper surfaces 14, 14' of the base 28.

Figure 4:
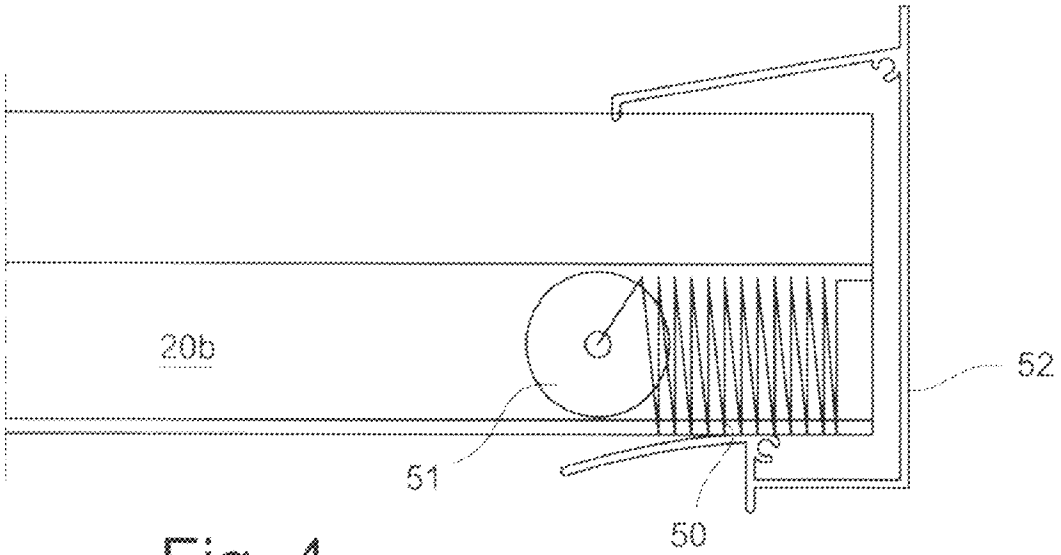
FIG. 4 shows a side view of a panels covering assembly according to the present invention.

Given that the covering 50 is of the bellow type as observable in FIG. 4, actuating the rollers 51 rolling in the channels 20*b*, 20*b*', in drive manner and/or in any other manner, allows moving the covering 50, possibly, according to the needs, up to entirely make it return into a containment structure 52 arranged at a rear end of the development of the assembly.

According to the invention, it is thus possible to selectively obtain a greater penetration of natural light into the area covered by the panels or a greater shielding thereof depending on the needs by simply actuating the rollers 51 to move the mobile covering 50 without the risk of jamming and or damaging the same during the movement thereof.

Alternatively, the rollers 51 can be replaced as mobile supports of the mobile covering 50 by the profiles with parallel surfaces 55 translating in the channels 20*b* 20*b'*.

In the illustrated example, such profiles with parallel surfaces are provided with a C-shaped section.

In such case, as shown in FIG. 3, the C-shaped supports 55 are guided at the upper part by the base walls 25, 25' and at the lower part by a double support constituted by the tips 56, 56' of the projections 29, 29', preferably rounded to reduce frictions, and by horizontal abutments 58, 58' provided on the flange 19 at the same height F2 as the tips 56, 56' of the projections 29, 29' with respect to the lower base 28.

Also in such latter case, just like in the previous one, actuating the C-shaped supports 55 in translation in the channels 20*b*, 20*b*', driven and/or in any other manner, allows moving the covering 50 according to the needs until it possibly entirely disappears into a containment structure 52 at the end of the extension of the connecting element.

This allows varying according to the needs the lighting and solar radiation within the panel closing assembly.

It has thus been observed that the elements for connecting panels and the panel closing assembly according to the present invention attain the previously outlined objects.

Actually the connecting elements of the present invention allow a simple and immediate coupling between the panels without the help of any additional connecting means between panels and joint, as well as the installation and the safe movement of the mobile covering elements of the panels to vary according to the needs the lighting and solar radiation within the structure.

Furthermore, the connecting elements of the present invention have good resistance characteristics both general and at the joining area where a large basin for collecting water which possibly penetrates between the adjacent panels is provided.

Actually, advantageously, the particular geometry of the snap-coupling of the present invention, provided by means of inclined walls operating only at the upper part against the enlarged end of the panels, prevents any kind or stagnation of water between the seat and panels and at the same time it increases the elasticity of the joint increasing the spring effect which allows positioning the panels.

Furthermore, the claimed coupling simplicity facilitates both the painting operations and the introduction of possible gaskets between the panels and the joint.

The connecting elements for panels and the panels as well as connecting elements assembly of the present invention thus conceived are susceptible to numerous modifications and variants, all falling within the same inventive concept; furthermore, all details can be replaced by technically equivalent elements. In practice, the materials used, as well as dimensions thereof, may vary according to the technical needs.

The invention claimed is:

1. Panel covering assembly comprising at least two adjacent panels (11, 12) having opposite ends where enlarged-head extensions (13) are positioned, and at least one connecting element connecting said two adjacent panels (11, 12), each connecting element comprising a flange (19) having a first end and a second end, said first end having a presser (19') that is arranged and configured symmetrically with respect to said flange (19), wherein said enlarged-head extensions (13)

at said opposite ends of said adjacent panels (11, 12) are inserted and kept respectively in upper first and second longitudinal channels (20*a*, 20*a*'), said flange (19) further comprising an enlarged base (28) at said second end, said upper first and second longitudinal channels (20*a*, 20*a*') being open in an area adjacent to said presser (19') and delimited by said flange (19) and by first and second lateral walls (22, 22') that are opposite to said flange (19) and by first and second base walls (25, 25') that connect said first and second lateral walls (22, 22') with said flange (19), said enlarged base (28) having first and second projections (29, 29'), which extend from a first end of said enlarged base (28) towards said first and second base walls (25, 25') said upper first and second longitudinal channels (20*b*, 20*b*') being delimited by said flange (19), said first or second base walls (25, 25'), said enlarged base (28) and said first or second projections (29, 29'); said first and second base walls (25, 25') extending in a direction orthogonal to said flange (19) and being substantially orthogonal to said first and second lateral walls (22, 22') and parallel to said flange (19); said enlarged base (28) being arranged substantially orthogonal to said flange (19); said first and second lateral walls (22, 22') being provided with snap-holding means (24, 24'), said enlarged-head extensions (13) being inserted into said upper first and second longitudinal channels (20*a*, 20*a*'), said snap-holding means (24, 24') operating on contact at an upper part with said enlarged-head extensions (13) and being positioned on the upper end of said first and second lateral walls (22, 22');

wherein said first and second base walls (25, 25') are extended orthogonally at least over a section equivalent to the distance between said flange (19) and said first and second projections (29, 29');

said first and second projections (29, 29') being substantially orthogonal to said enlarged base (28) and parallel to said flange (19);

said first and second projections (29, 29') being substantially flush (F1) with said first said second lateral walls (22, 22'), and said first and second lateral walls (22, 22') being extended vertically from said first and second base walls (25, 25') up to said snap-holding means (24, 24').

2. Panel covering assembly according to claim 1 wherein said snap-holding means (24, 24') of said enlarged-head extension (13) are inserted into said upper first and second longitudinal channels (20*a*, 20*a*') and said snap-holding means have an inclined surface (24, 24') and said snap-holding means (24,24') are positioned at an upper end of said first lateral walls (22, 22').

3. Panel covering assembly according to claim 1 wherein said snap-holding means have lower ends (26, 26') with a rounded profile that are directed towards central wall bases (25, 25') for holding said enlarged-head extensions (13).

4. Panel covering assembly according to claim 1 wherein said assembly comprises a horizontal abutment (58) provided on said flange (19) at the same height (F2) as tips (56, 56') of said first and second projections (29, 29') with respect to said enlarged base (28).

5. Panel covering assembly according to claim 1 wherein said base (28) comprises upper surfaces (14, 14') that are downwardly inclined, towards said projections (29, 29'), relative to said flange (19).

6. Panel covering assembly according to claim 1 wherein two mobile support ends of two mobile coverings are inserted respectively in said lower first and second longitudinal channels (20*b*, 20*b*') that are disposed between said base walls (25, 25') and said enlarged base (28).

7. Panel covering assembly according to claim 6 wherein said mobile support ends of said coverings comprise roller elements (51) rotatabiy movable in said lower first and second longitudinal channels (20*b*, 20*b*'), said rollers being guided by said enlarged base (28) from below, by said projections (29, 29') from the side and by said base walls (25, 25') from above.

8. Panel covering assembly according to claim 6 wherein said mobile support ends of said coverings comprise profiles with parallel surfaces (55) translationally movable in said lower first and second longitudinal channels (20*b*, 20*b*'), said rollers being guided by said projections (29, 29') from below and by horizontal abutments (58, 58') provided at said flange (19) and by said base walls (25, 25') from above.

* * * * *